US009017012B2

(12) United States Patent
Brunelli et al.

(10) Patent No.: US 9,017,012 B2
(45) Date of Patent: Apr. 28, 2015

(54) RING SEGMENT WITH COOLING FLUID SUPPLY TRENCH

(75) Inventors: Marco Claudio Pio Brunelli, Orlando, FL (US); Sameer A. Khan, Orlando, FL (US); Kenneth K. Landis, Tequesta, FL (US); Walter H. Marussich, Palm Beach Gardens, FL (US); Nicholas F. Martin, York, SC (US); Beatriz Suarez-Crosse, West Palm Beach, FL (US); William W. Pankey, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 634 days.

(21) Appl. No.: 13/281,727

(22) Filed: Oct. 26, 2011

(65) Prior Publication Data

US 2013/0108419 A1 May 2, 2013

(51) Int. Cl.

| | |
|---|---|
| ***F01D 11/00*** | (2006.01) |
| ***F01D 25/12*** | (2006.01) |
| ***F01D 9/04*** | (2006.01) |

(52) U.S. Cl.

CPC ..... *F01D 25/12* (2013.01); *F01D 9/04* (2013.01); *F05D 2240/11* (2013.01); *F05D 2260/201* (2013.01)

(58) Field of Classification Search

CPC ..... F01D 25/08; F01D 25/12; F01D 9/06; F01D 9/065

USPC ..... 415/115, 116, 173.7, 175, 176, 173.1; 416/95, 96 R, 97 R

See application file for complete search history.

(56) References Cited

U.S. PATENT DOCUMENTS

| | | | | |
|---|---|---|---|---|
| 3,728,039 | A | 4/1973 | Plemmons et al. | |
| 3,825,364 | A | 7/1974 | Halila et al. | |
| 4,497,610 | A | 2/1985 | Richardson et al. | |
| 4,573,865 | A | 3/1986 | Hsia et al. | |
| 4,679,981 | A | 7/1987 | Guibert et al. | |
| 4,752,184 | A | 6/1988 | Liang | |
| 5,169,287 | A | 12/1992 | Proctor et al. | |
| 5,374,161 | A | 12/1994 | Kelch et al. | |
| 5,375,973 | A | 12/1994 | Sloop et al. | |
| 5,380,150 | A | 1/1995 | Stahl | |
| 5,486,090 | A | 1/1996 | Thompson et al. | |
| 5,538,393 | A | 7/1996 | Thompson et al. | |
| 6,155,778 | A | 12/2000 | Lee et al. | |
| 7,033,138 | B2 | 4/2006 | Tomita et al. | |
| 7,246,993 | B2 | 7/2007 | Bolms et al. | |
| 7,284,954 | B2 | 10/2007 | Parker et al. | |
| 7,306,424 | B2 * | 12/2007 | Romanov et al. | 415/115 |
| 7,665,962 | B1 | 2/2010 | Liang | |
| 7,670,108 | B2 | 3/2010 | Liang | |

(Continued)

FOREIGN PATENT DOCUMENTS

| | | | |
|---|---|---|---|
| EP | 0694677 | A1 | 1/1996 |

*Primary Examiner* — Dwayne J White
*Assistant Examiner* — Jason Fountain

(57) ABSTRACT

A ring segment for a gas turbine engine includes a panel and a cooling system. The cooling system is provided within the panel and includes a cooling fluid supply trench having an open top portion and extending radially inwardly from a central recessed portion of the panel. The cooling system further includes a plurality of cooling fluid passages extending from the cooling fluid supply trench to a leading edge and/or a trailing edge of the panel. The cooling fluid passages receive cooling fluid from the cooling fluid supply trench, wherein the cooling fluid provides convective cooling to the panel as it passes through the cooling fluid passages.

19 Claims, 5 Drawing Sheets

(56) References Cited

U.S. PATENT DOCUMENTS 8,480,353 B2 * 7/2013 Koyabu et al. ..... 415/116
8,550,778 B2 * 10/2013 Koyabu et al. ..... 416/97 R
8,727,704 B2 * 5/2014 Lee et al. ..... 415/116
2007/0020088 A1 * 1/2007 Durocher et al. ..... 415/115
2011/0044805 A1 * 2/2011 Koyabu et al. ..... 415/177
2013/0011238 A1 * 1/2013 Liang et al. ..... 415/115

* cited by examiner

RING SEGMENT WITH COOLING FLUID SUPPLY TRENCH

FIELD OF THE INVENTION

The present invention relates to ring segments for gas turbine engines and, more particularly, to cooling of ring segments in gas turbine engines.

BACKGROUND OF THE INVENTION

It is known that the maximum power output of a combustion turbine is achieved by heating the gas flowing through the combustion section to as high a temperature as is feasible. The hot gas, however, heats the various turbine components, such as airfoils and ring segments, which it passes when flowing through the turbine section. One aspect limiting the ability to increase the combustion firing temperature is the ability of the turbine components to withstand increased temperatures. Consequently, various cooling methods have been developed to cool turbine hot parts.

In the case of ring segments, ring segments typically may include an impingement tube, also known as an impingement plate, associated with the ring segment and defining a plenum between the impingement tube and the ring segment. The impingement tube may include holes for passage of cooling fluid into the plenum, wherein cooling fluid passing through the holes in the impingement tube may impinge on the outer surface of the ring segment to provide impingement cooling to the ring segment. In addition, further cooling structure, such as internal cooling passages, may be formed in the ring segment to facilitate cooling thereof.

SUMMARY OF THE INVENTION

In accordance with a first aspect of the invention, a ring segment is provided for a gas turbine engine. The ring segment comprises a panel and a cooling system. The panel comprises an outer side, an inner side, and a plurality of side edges including a leading edge, a trailing edge, a first mating edge, and a second mating edge. Cooling fluid is provided to the outer side and the inner side defines at least a portion of a hot gas flow path through the gas turbine engine. The panel further includes a central recessed portion defining a recessed surface formed in the outer side and surrounded by a rim portion comprising an unrecessed portion extending around an outer periphery of the recessed portion along each of the side edges. The cooling system is provided within the panel and receives cooling fluid from the outer side of the panel for cooling the panel. The cooling system comprises a cooling fluid supply trench having an open top portion and extending radially inwardly from the recessed portion of the panel. The cooling fluid supply trench receives cooling fluid from the outer side of the panel. The cooling system further comprises a plurality of cooling fluid passages extending from the cooling fluid supply trench to at least one of the leading edge and the trailing edge of the panel. The cooling fluid passages receive cooling fluid from the cooling fluid supply trench and the cooling fluid provides convective cooling to the panel as it passes through the cooling fluid passages.

In accordance with a second aspect of the invention, a ring segment is provided for a gas turbine engine. The ring segment comprises a panel comprising a plurality of side edges including a leading edge, a trailing edge, a first mating edge, and a second mating edge. The panel further comprises an outer side and an inner side, wherein cooling fluid is provided to the outer side and the inner side defines at least a portion of a hot gas flow path through the gas turbine engine. The ring segment further comprises a cooling system within the panel that receives cooling fluid from the outer side of the panel for cooling the panel. The cooling system comprises a plurality of cooling fluid passages, each cooling fluid passage comprising a cooling fluid inlet located about mid-way between the leading and trailing edges of the panel, and a cooling fluid outlet located at the leading edge and/or the trailing edge of the panel. The cooling fluid passages receive cooling fluid from the outer side of the panel and the cooling fluid provides convective cooling to the panel as it passes through the cooling fluid passages.

In accordance with a third aspect of the invention, a ring segment is provided for a gas turbine engine. The ring segment comprises a panel comprising a plurality of side edges including a leading edge, a trailing edge, a first mating edge, and a second mating edge. The panel further comprises an outer side and an inner side, wherein cooling fluid is provided to the outer side and the inner side defines at least a portion of a hot gas flow path through the gas turbine engine. The ring segment further comprises a cooling system within the panel that receives cooling fluid from the outer side of the panel for cooling the panel. The cooling system comprises a cooling fluid supply trench and a plurality of cooling fluid passages. The cooling fluid supply trench has an open top portion, extends radially inwardly from the outer side of the panel, and receives cooling fluid from the outer side of the panel. A width dimension of the cooling fluid supply trench measured in an axial direction of the engine is at least one of: less than about 1/10 of a length dimension of the cooling fluid supply trench measured in a circumferential direction of the engine; and about the same as a depth dimension of the cooling fluid supply trench measured in a radial direction of the engine. The cooling fluid passages extend from the cooling fluid supply trench to the leading edge and/or the trailing edge of the panel. The cooling fluid passages receive cooling fluid from the cooling fluid supply trench, and the cooling fluid provides convective cooling to the panel as it passes through the cooling fluid passages.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
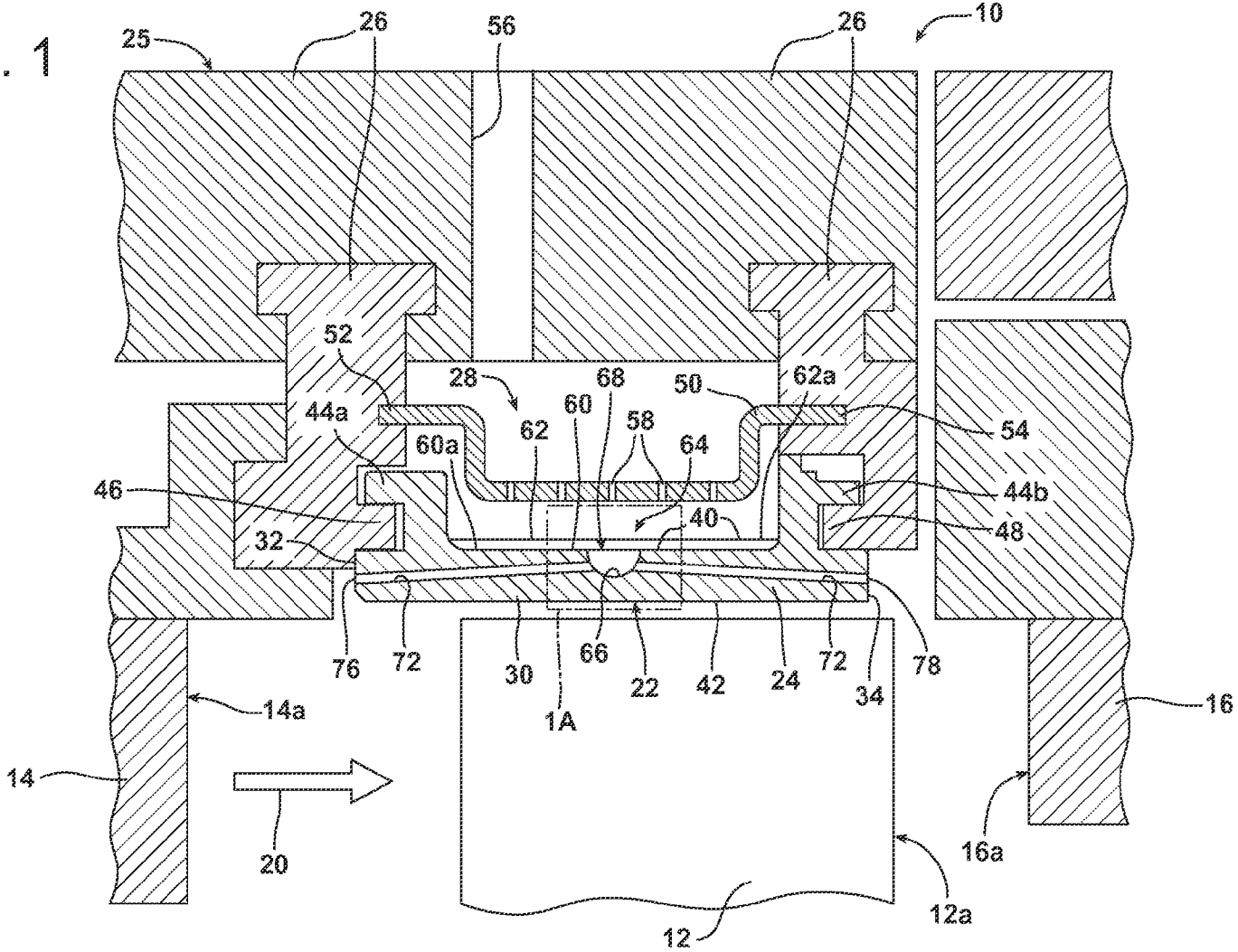
FIG. 1 is cross sectional view of a portion of a turbine section of a gas turbine engine, including a ring segment constructed in accordance with the present invention.

FIG. 1 illustrates a portion of a turbine section 10 of a gas turbine engine. Within the turbine section 10 are alternating rows of stationary vanes and rotating blades. In FIG. 1, a single blade 12 forming a row 12*a* of blades is illustrated. Also illustrated in FIG. 1 are part of an upstream vane 14 forming a row 14*a* of upstream vanes, and part of a downstream vane 16 forming a row 16*a* of downstream vanes. The blades 12 are coupled to a disc (not shown) of a rotor assembly. A hot working gas from a combustor (not shown) in the engine flows in a hot gas flow path 20 passing through the turbine section 10. The working gas expands through the turbine 10 as it flows through the hot gas flow path 20 and causes the blades 12, and therefore the rotor assembly, to rotate.

In accordance with an aspect of the invention, an outer seal structure 22 is provided about and adjacent the row 12*a* of blades. The outer seal structure 22 comprises a plurality of ring segments 24, which, when positioned side by side in a circumferential direction of the engine, define the outer seal structure 22. The outer seal structure 22 has a ring shape so as to extend circumferentially about its corresponding row 12*a* of blades. A corresponding one of the outer seal structures 22 may be provided about each row of blades provided in the turbine section 10.

The outer seal structure 22 comprises an inner wall of a turbine housing 25 in which the rotating blade rows are provided and defines sealing structure for preventing or limiting the working gas from passing through the inner wall and reaching other structure of the turbine housing, such as a blade ring carrier 26 and an associated annular cooling fluid plenum 28. It is noted that the terms "inner", "outer", "radial", "axial", "circumferential", and the like, as used herein, are not intended to be limiting with regard to orientation of the elements recited for the present invention.

Figure 2:
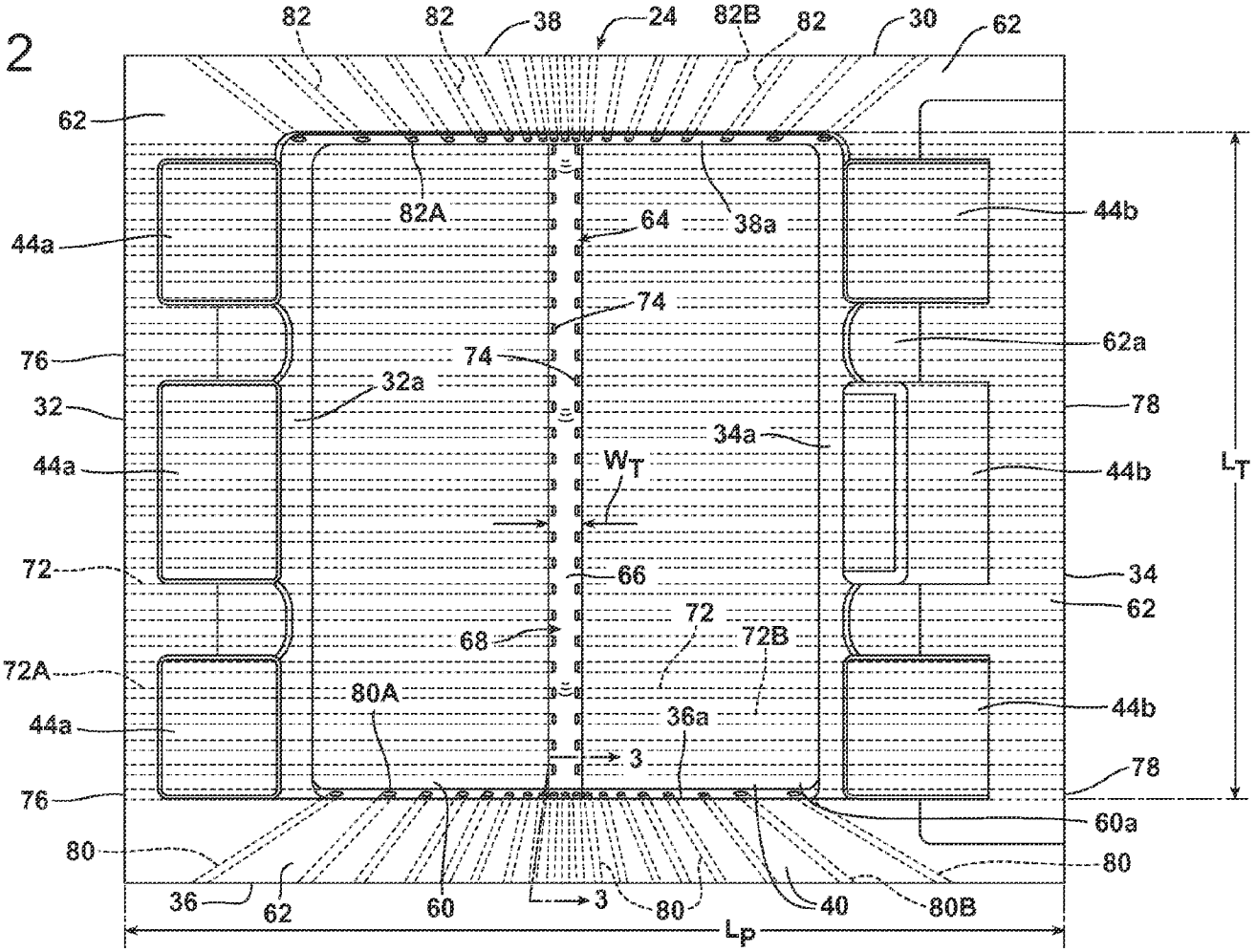
FIG. 2 is a top plan view of the ring segment illustrated in FIG. 1.

Referring to FIGS. 1 and 2, a single one of the ring segments 24 of the outer seal structure 22 is shown, it being understood that the other ring segments 24 of the outer seal structure 22 are generally identical to the single ring segment 24 shown and described. The ring segment 24 comprises a panel 30 including side edges comprising a leading edge 32, a trailing edge 34, a first mating edge 36 (see FIG. 2), and a second mating edge 38 (see FIG. 2). The panel 30 further includes an outer side 40 (see FIG. 1) and an inner side 42 (see FIG. 1), wherein the inner side 42 defines a corresponding portion of the hot gas flow path 20.

The panel 30 defines a structural body for the ring segment 24, and includes one or more front flanges or hook members 44*a* and one or more rear flanges or hook members 44*b*, see FIG. 1. The front and rear hook members 44*a*, 44*b* are rigidly attached to the panel 30, and may be formed with the panel 30 as an integral casting, or may be formed separately and subsequently rigidly attached to the panel 30. Moreover, if formed separately from the panel 30 the hook members 44*a*, 44*b* may be formed of the same material or a different material than the panel 30. Each ring segment 24 is mounted within the turbine section 10 via the front hook members 44*a* engaging a corresponding structure 46 of the blade ring carrier 26, and the rear hook members 44*b* engaging a corresponding structure 48 of the blade ring carrier 26, as seen in FIG. 1.

Referring to FIG. 1, the blade ring carrier 26 defines, in cooperation with an impingement tube 50, also known as an impingement plate, the annular cooling fluid plenum 28, which defines a source of cooling fluid for the seal structure 22, as is described further below. The impingement tube 50 is secured to the blade ring carrier 26 at fore and aft locations 52, 54, as shown in FIG. 1. The cooling fluid plenum 28 receives cooling fluid through a channel 56 formed in the blade ring carrier 26 from a source of cooling fluid, such as bleed air from a compressor (not shown) of the gas turbine engine. As shown in FIG. 1, the impingement tube 50 includes a plurality of impingement holes 58 therein. Cooling fluid in the cooling fluid plenum 28 flows through the impingement holes 58 in the impingement tube 50 and impinges on the outer side 40 of the panel 30 during operation, as will be discussed herein.

Referring to FIGS. 1 and 2, the outer side 40 of the illustrated panel 30 is formed with an indented or central recessed portion 60 defining a recessed surface 60*a* of the panel 30. The outer side 40 of the panel 30 further comprises a rim portion 62 surrounding the central recessed portion 60. The rim portion 62 comprises an unrecessed portion 62*a* extending around a periphery of the central recessed portion 60 along each of the side edges, i.e., the leading edge 32, the trailing edge 34, the first mating edge 36, and the second mating edge 38. First, second, third, and fourth recess portion walls 32*a*, 34*a*, 36*a*, 38*a*, i.e., corresponding to the leading edge 32, the trailing edge 34, the first mating edge 36, and the second mating edge 38 (see FIG. 2), extend at least partially in the radial direction between the recessed surface 60*a* and the unrecessed portion 62*a* and define the outer periphery of the central recessed portion 60. It should be noted that the outer side 40 of the panel 30 need not comprise the central recessed portion 60 and the rim portion 62 and may comprise, for example, an area that is substantially entirely planar.

Figure 1A:
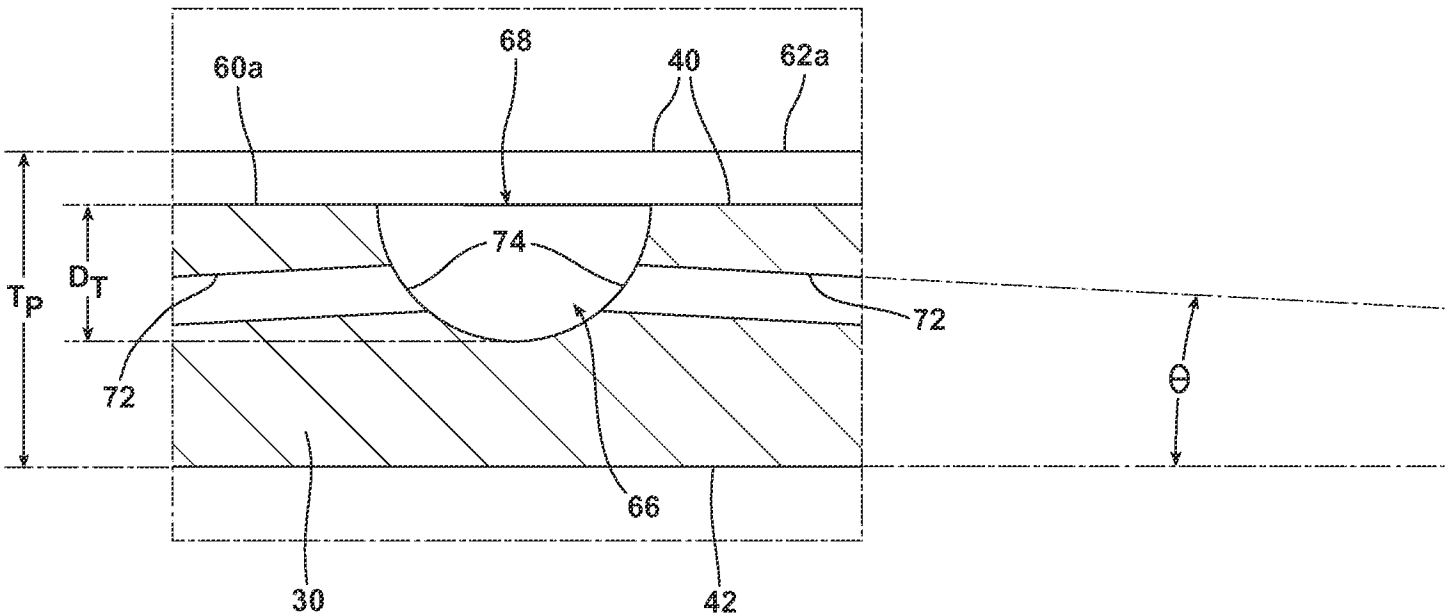
FIG. 1*a* is an enlarged view of the portion of FIG. 1 designated by the box 1*a;*

Referring to FIGS. 1 and 2, the panel 30 comprises a cooling system 64. The cooling system 64 according to this embodiment comprises a single cooling fluid supply trench 66. The trench 66 is located within the central recessed portion 60 of the panel 30 and extends radially inwardly from the recessed surface 60*a* toward the inner side 42 of the panel 30, see also FIG. 1*a*. As shown in FIG. 1*a*, the trench 66 comprises an open top portion 68 at the recessed surface 60*a*, which open top portion 68 receives cooling fluid from the outer side 40 of the panel 30 as will be discussed herein. In the embodiment shown, the trench 66 is located about midway between the leading and trailing edges 32, 34 of the panel 30 (see FIGS. 1 and 2), although the trench 66 could be located at other locations.

Referring to FIG. 2, the trench 66 in the embodiment shown extends in the circumferential direction of the engine across substantially the entire recessed surface 60*a* of the panel 30, i.e., from the third recess portion wall 36*a* to the fourth recess portion wall 38*a*, such that a length $L_T$ of the trench 66 is generally equal to a circumferential distance between the third and fourth recessed portion walls 36*a*, 38*a*. It is noted that trench dimensions different than the ones described herein are contemplated, i.e., the trench 66 is not intended to be limited to the described configuration with the described dimensions. The trench 66 in the embodiment shown has a width $W_T$ that is preferably from about 2 mm to about 20 mm, see FIG. 2, and may generally define a semicircular cross section, although the invention is not intended to be limited to a specific trench width $W_T$. Moreover, the trench width $W_T$ is preferably smaller than about 1/10 of the trench length $L_T$ and may be generally equal to a depth $D_T$ (see FIG. 1*a*) of the trench 66. The depth $D_T$ of the trench 66 is preferably between about 1/4 to about 1/2 of a thickness $T_P$ of the panel 30 (see FIG. 1*a*), but the trench 66 could have other suitable depths $D_T$. It is noted that the trench 66 is preferably configured so as to minimize the impact on the structural integrity of the panel 30.

As shown in FIGS. 1 and 2, the cooling system 64 further comprises a plurality of cooling fluid passages 72 that are associated with the trench 66. The cooling fluid passages 72 comprise leading edge cooling passages 72A that extend from the trench 66 to the leading edge 32 of the panel 30 and trailing edge cooling passages 72B that extend from the trench 66 to the trailing edge 34 of the panel 30. It is noted that any suitable number of cooling fluid passages 72 may be provided in the cooling system 64. Further, the number of leading edge cooling passages 72A may be the same or different than the number of trailing edge cooling passages 72B, and the sizes of the leading edge cooling passages 72A may be the same or different than the sizes of trailing edge cooling passages 72B.

The cooling fluid passages 72 include inlets 74 in communication with the trench 66, see FIGS. 1*a* and 2. The inlets 74 receive cooling fluid from the trench 66 and are located radially inwardly from the recessed surface 60*a* of the panel 30, i.e., within the trench 66. Since the trench 66 according to this embodiment is generally located midway between the leading and trailing edges 32, 34 of the panel 30, and since the width $W_T$ of the trench 66 is relatively small compared to an axial length $L_P$ (see FIG. 2) of the panel 30, the inlets 74 of the cooling fluid passages 72 are also located generally midway between the leading and trailing edges 32, 34 of the panel 30. As shown in FIG. 1A, the cooling fluid passages 72 extend radially inwardly at an angle θ of from about 0 to about 45 degrees relative to the axial direction but may extend at other angles relative to the axial direction as desired, i.e., the invention is not intended to be limited to the cooling fluid passages 72 extending at a specific angle θ. The radially inward extension of the cooling fluid passages 72 allows cooling fluid passing through the cooling fluid passages 72 to come into close proximity to the inner side 42 of the panel 30 so as to increase cooling provided to the inner side 42 of the panel 30, as will be discussed herein.

Referring to FIGS. 1 and 2, the leading edge cooling passages 72A comprise outlets 76 located at the leading edge 32 of the panel 30, and the trailing edge cooling passages 72B comprise outlets 78 at the trailing edge 34 of the panel 30. As will be discussed herein, cooling fluid flowing through the cooling fluid passages 72 passes out of the respective outlets 76, 78 and is mixed with the hot working gas flowing through the hot gas flow path 20.

Figure 3:
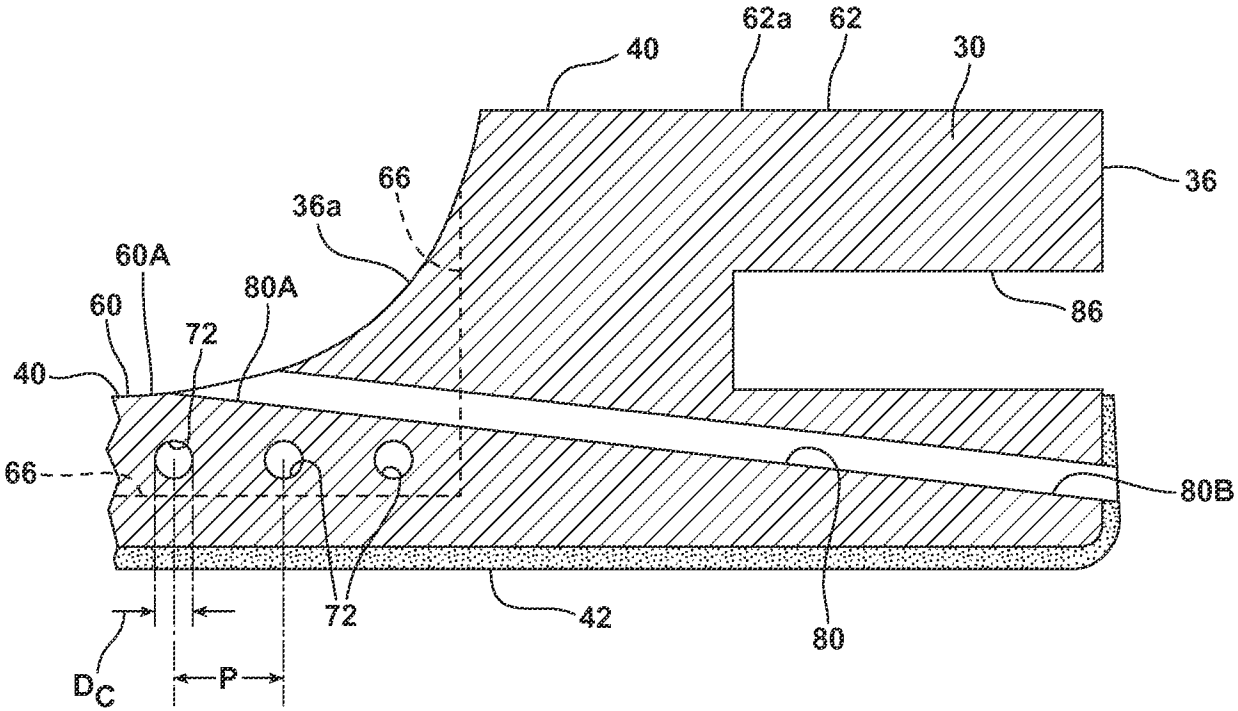
FIG. 3 is a cross sectional view taken along line 3-3 in FIG. 2.

Referring to FIG. 3, the cooling fluid passages 72 preferably comprise a diameter $D_C$ of from about 0.25 mm to about 2.0 mm. The diameter $D_C$ of the cooling fluid passages 72 may be less than about ½ of the width $W_T$ of the trench 66, i.e., the width $W_T$ of the trench 66 may be at least about 2 times greater than the diameter $D_C$ of the cooling fluid passages 72. Further, a pitch P (see FIG. 3) between adjacent cooling fluid passages 72 is preferably between about 0.5 mm and about 16 mm. In a most preferred embodiment, the cooling system 64 comprises at least about 4 cooling fluid passages per cm, as measured in the circumferential direction, and a ratio of the diameter $D_C$ of the cooling fluid passages 72 to the pitch P between adjacent cooling fluid passages 72 is between about 0.2 and about 0.5.

Referring to FIGS. 2 and 3, the cooling system 64 further comprises a plurality of first and second mating edge cooling passageways 80, 82 (only a first mating edge cooling passageway 80 is illustrated in FIG. 3). The first and second mating edge cooling passageways 80, 82 extend from the outer side 40 of the panel 30, i.e., from the respective third, and fourth recess portion walls 36*a*, 38*a*, to the first and second mating edges 36, 38 of the panel 30. The first and second mating edge cooling passageways 80, 82 deliver portions of the cooling fluid from the outer side 40 of the panel to the first and second mating edges 36, 38 of the panel 30, as will be discussed herein.

As shown in FIG. 2, ones of the first and second mating edge cooling passageways 80, 82 located toward the leading edge 32 of the panel 30 may be angled toward the leading edge 32 to supply cooling fluid to the respective mating edges 36, 38 near the leading edge 32. Additionally, ones of the first and second mating edge cooling passageways 80, 82 located toward the trailing edge 34 of the panel 30 may be angled toward the trailing edge 34 to supply cooling fluid to the respective mating edges 36, 38 near the trailing edge 34. Moreover, as shown in FIG. 3, the first and second mating edge cooling passageways 80, 82 may be angled radially inwardly from the outer side 40 of the panel 30. Such an inward angle results in entrance portions 80A, 82A of the first and second mating edge cooling passageways 80, 82 located at the recess portion walls 36*a*, 38*a* being located radially outwardly from the cooling fluid passages 72, while discharge portions 80B, 82B of the first and second mating edge cooling passageways 80, 82 located at the first and second mating edges 36, 38 being located radially inwardly from axial slots 86 (see FIG. 3) of the panel 30. Hence, cooling fluid can be discharged radially inwardly from the axial slots 86, as will be discussed below. The axial slots 86 receive axial seals (not shown) that extend to respective mating edges of adjacent ring segments (not shown), as will be apparent to those skilled in the art.

During operation of the engine, cooling fluid is supplied to the cooling fluid plenum 28 via the channel 56 formed in the blade ring carrier 26. The cooling fluid in the cooling fluid plenum 28 flows through the impingement holes 58 in the impingement tube 50 and impinges on the outer side 40 of the panel 30 to provide impingement cooling to the outer side 40 of the panel 30. Portions of this cooling fluid pass into the cooling system 64 of each ring segment 24. Specifically, a portion of the cooling fluid is provided into the trench 66 and then into the cooling fluid passages 72, wherein the cooling fluid provides convective cooling to the panel 30 as it passes through the cooling fluid passages 72. Since the inlets 74 of the cooling fluid passages 72 are located in the trench 66 and are thus located radially inwardly from the recessed surface 60*a* of the panel 30, the cooling fluid flows through the cooling fluid passages 72 closer to the inner side 42 of the panel 30. Hence, the cooling fluid passages 72 effect a greater amount of cooling for the inner side 42 of the panel 30 than if the cooling fluid passages were located farther from the inner side 42 of the panel 30, i.e., at the recessed surface 60*a*.

Portions of the cooling fluid from the outer side 40 of the panel 30 are also provided into the first and second mating edge cooling passageways 80, 82 of the cooling system 64. These portions of cooling fluid provide convective cooling to the panel 30 as they pass through the first and second mating edge cooling passageways 80, 82 and then provide cooling to the axial seals within the axial slots 86 of the panels 30. Since the first and second mating edge cooling passageways 80, 82 are angled radially inwardly, they are able to commence radially outwardly from the cooling fluid passages 72 and discharge cooling fluid radially inwardly from the axial slots 86.

The portions of cooling fluid discharged from the cooling fluid passages 72 and the mating edge cooling passageways 80, 82 are then mixed with the hot working gas passing through the hot gas path 20. However, the portions of the cooling fluid discharged from the mating edge cooling passageways 80, 82 may remain for a time within the axial slots 86 so as to provide a barrier or wall of cooling fluid within the axial slots 86.

It is believed that the present configuration for the ring segments 24 provides an efficient cooling of the panels 30 via the convective cooling provided by the cooling fluid passing through the respective cooling systems 64 without a large impact on the structural integrity of the panel 30. Such efficient cooling of the ring segments 24 is believed to result in a lower cooling fluid requirement than prior art ring segments. Hence, enhanced cooling may be provided within the ring segments 24 while minimizing the volume of cooling fluid discharged from the ring segments 24 into the hot working gas, thus resulting in an associated improvement in engine efficiency, i.e., since a lesser amount of cooling fluid is mixed into the hot gas path 20, aerodynamic mixing losses of the hot working gas are reduced. Further, the distributed cooling provided to the panels 30 by the cooling systems 64, i.e., due to each cooling fluid passage 72 being generally located close to the inner side 42 of the panel 30, and due to the number and location of cooling fluid passages 72, is believed to reduce a temperature gradient throughout the panel 30, thus resulting in a reduction in thermal stress of the panel 30 and an improved or extended life of the ring segments 24.

Moreover, the number of leading and trailing edge cooling fluid passages 72 may be provided to fine tune cooling of the panel 30. For example, if a region toward the leading edge 32 of the panel 30 requires a large amount of cooling, a sufficient number and/or size of leading edge cooling fluid passages 72A can be provided to remove a large amount heat from the panel 30 in this region. As another example, if a region of the panel 30 toward the trailing edge 34 does not require as much cooling, the number and/or size of trailing edge cooling fluid passages 72B can be provided to remove a lesser amount of heat from the panel 30 in this region, i.e., so as to conserve more cooling fluid for other locations.

Figure 4:
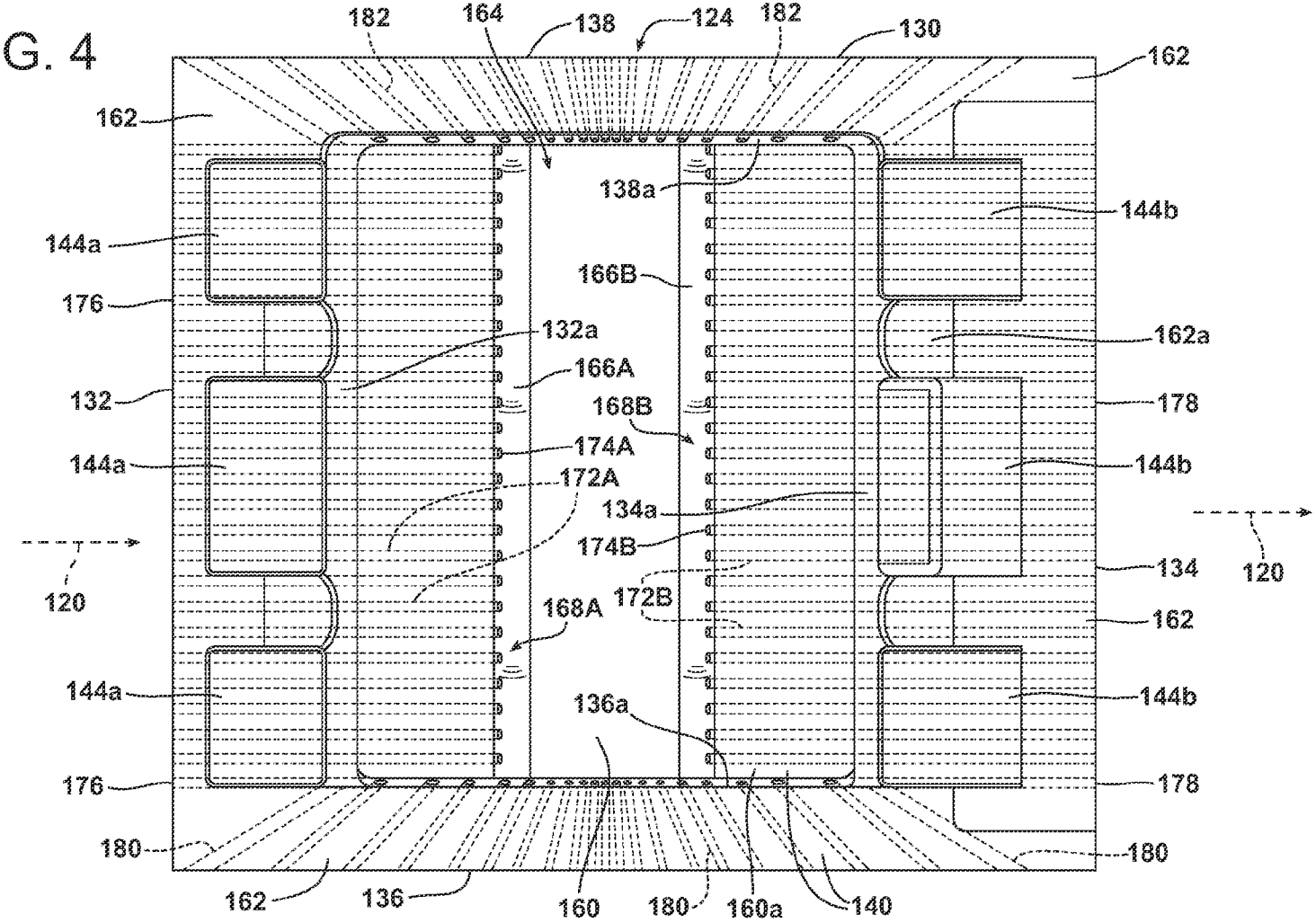
FIG. 4 is a top plan view of a ring segment constructed in accordance with another embodiment of the present invention.

Referring to FIG. 4, a cooling system 164 according to another embodiment of the invention is shown, wherein structure similar to that described above with reference to FIGS. 1, 1A, 2 and 3 includes the same reference number increased by 100.

In this embodiment, the cooling system 164 comprises two cooling fluid supply trenches, i.e., a first cooling fluid supply trench 166A and a second cooling fluid supply trench 166B. Each of the trenches 166A, 166B extends in the circumferential direction of the engine. In the embodiment shown, the first trench 166A is located axially closer to the leading edge 132 of the panel 130 than to the trailing edge 134, and the second trench 166B is located axially closer to the trailing edge 134 of the panel 130 than to the leading edge 132, i.e., the second trench 166B is located downstream from the first trench 166A with respect to a direction of flow of the hot working gas through the hot gas flow path 120.

Each trench 166A, 166B includes an open top portion 168A, 168B that receives cooling fluid from the outer side 140 of the panel 130. The first trench 166A is associated with leading edge cooling fluid passages 172A that extend from the first trench 166A to the leading edge 132 of the panel 130, and the second trench 166B is associated with trailing edge cooling fluid passages 172B that extend from the second trench 166B to the trailing edge 132 of the panel 130. The leading and trailing edge cooling fluid passages 172A, 172B each include inlets 174A, 174B and outlets 176, 178 such that cooling fluid can flow therethrough to provide convective cooling for the panel 130 as described above.

The number and size of leading and trailing edge cooling fluid passages 172A, 172B can be configured to fine tune cooling to the various sections of the panel 130. For example, if a larger amount of cooling is needed for areas of the panel 130 near the leading edge 132 than for areas near the trailing edge 134, a greater number and/or size of leading edge cooling fluid passages 172A than trailing edge cooling fluid passages 172B may be provided.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A ring segment for a gas turbine engine comprising:

a panel comprising:

a plurality of side edges including a leading edge, a trailing edge, a first mating edge, and a second mating edge;

an outer side and an inner side, wherein cooling fluid is provided to said outer side and said inner side defines at least a portion of a hot gas flow path through the gas turbine engine; and a central recessed portion defining a recessed surface formed in said outer side and surrounded by a rim portion comprising an unrecessed portion extending around an outer periphery of said central recessed portion along each of said side edges; and a cooling system within said panel that receives cooling fluid from said outer side of said panel for cooling said panel, said cooling system comprising:

a cooling fluid supply trench having an open top portion and extending radially inwardly from said central recessed portion of said panel, said cooling fluid supply trench receiving cooling fluid from said outer side of said panel; and a plurality of cooling fluid passages extending from said cooling fluid supply trench to said leading edge of said panel and a plurality of cooling fluid passages extending from said cooling fluid supply trench to said trailing edge of said panel, wherein said cooling fluid passages receive cooling fluid from said cooling fluid supply trench, said cooling fluid providing convective cooling to said panel as it passes through said cooling fluid passages;

wherein a width dimension of said cooling fluid supply trench measured in an axial direction of the engine is at least one of:

less than about 1/10 of a length dimension of said cooling fluid supply trench measured in a direction extending between said first mating edge and said second mating edge of said panel;

about the same as a depth dimension of said cooling fluid supply trench measured in a radial direction of the engine; and at least about 2 times a diameter of said cooling fluid passages.

2. The ring segment of claim 1, wherein said cooling fluid supply trench extends across said recessed surface in the direction extending between said first mating edge and said second mating edge of said panel.

3. The ring segment of claim 2, wherein said cooling fluid supply trench is located about midway between said leading and trailing edges of said panel.

4. The ring segment of claim 2, wherein said cooling fluid supply trench spans across substantially the entire recessed surface.

5. The ring segment of claim 2, wherein said cooling system comprises at least about 4 cooling fluid passages per cm, as measured in the direction extending between said first mating edge and said second mating edge of said panel.

6. The ring segment of claim 1, wherein said cooling fluid passages have a diameter of from about 0.25 mm to about 2 mm, and wherein a pitch between adjacent ones of said cooling fluid passages comprises from about 0.5 mm to about 16 mm.

7. The ring segment of claim 1, wherein the width dimension of said cooling fluid supply trench is about 2 times the diameter of said cooling fluid passages.

8. The ring segment of claim 1, wherein a ratio of the diameter of said cooling fluid passages to a pitch between adjacent cooling fluid passages is from about 0.2 to about 0.5.

9. The ring segment of claim 1, wherein cooling fluid inlets of said cooling fluid passages are located radially inwardly from said recessed surface.

10. The ring segment of claim 1, wherein said cooling fluid supply trench comprises a first cooling fluid supply trench and is associated with the cooling fluid passages that extend to said leading edge, and further comprising a second cooling fluid supply trench spaced from said first cooling fluid supply trench and located between said first cooling fluid supply trench and said trailing edge of said panel, said second cooling fluid supply trench receiving cooling fluid from said outer side of said panel and being associated with the cooling fluid passages that extend to said trailing edge.

11. The ring segment of claim 1, further comprising first and second mating edge cooling passageways extending from said outer side of said panel to respective first and second mating edges of said panel.

12. The ring segment of claim 11, wherein portions of said first and second mating edge cooling passageways are located radially outwardly from said cooling fluid passages.

13. A ring segment for a gas turbine engine comprising:

a panel comprising a plurality of side edges including a leading edge, a trailing edge, a first mating edge, and a second mating edge, said panel further comprising an outer side and an inner side, wherein cooling fluid is provided to said outer side and said inner side defines at least a portion of a hot gas flow path through the gas turbine engine;

a cooling system within said panel that receives cooling fluid from said outer side of said panel for cooling said panel, said cooling system comprising:

a first cooling fluid supply trench having an open top portion and extending radially inwardly from said outer side of said panel, said first cooling fluid supply trench associated with cooling fluid passages that extend to said leading edge of said panel; and a second cooling fluid supply trench spaced from said first cooling fluid supply trench and located between said first cooling fluid supply trench and said trailing edge of said panel, said second cooling fluid supply trench having an open top portion and extending radially inwardly from said outer side of said panel, said second cooling fluid supply trench associated with cooling fluid passages that extend to said trailing edge of said panel;

wherein said cooling fluid passages associated with said first and second cooling fluid supply trenches receive cooling fluid from said outer side of said panel via the respective first and second cooling fluid supply trenches and said cooling fluid provides convective cooling to said panel as it passes through said cooling fluid passages.

14. The ring segment of claim 13, wherein cooling fluid inlets of said cooling fluid passages associated with said first and second cooling fluid supply trenches are located radially inwardly from said outer side of said panel.

15. A ring segment for a gas turbine engine comprising:

a panel comprising a plurality of side edges including a leading edge, a trailing edge, a first mating edge, and a second mating edge, said panel further comprising an outer side and an inner side, wherein cooling fluid is provided to said outer side and said inner side defines at least a portion of a hot gas flow path through the gas turbine engine;

a cooling system within said panel that receives cooling fluid from said outer side of said panel for cooling said panel, said cooling system comprising:

a cooling fluid supply trench having an open top portion and extending radially inwardly from said outer side of said panel, said cooling fluid supply trench receiving cooling fluid from said outer side of said panel, wherein a width dimension of said cooling fluid supply trench measured in an axial direction of the engine is at least one of:

less than about 1/10 of a length dimension of said cooling fluid supply trench measured in a direction extending between said first mating edge and said second mating edge of said panel; and about the same as a depth dimension of said cooling fluid supply trench measured in a radial direction of the engine; and a plurality of cooling fluid passages extending from said cooling fluid supply trench to at least one of said leading edge and said trailing edge of said panel, wherein said cooling fluid passages receive cooling fluid from said cooling fluid supply trench, said cooling fluid providing convective cooling to said panel as it passes through said cooling fluid passages;

wherein said cooling system comprises at least about 4 cooling fluid passages per cm, as measured in the direction extending between said first mating edge and said second mating edge of said panel.

16. The ring segment of claim 15, wherein said cooling system comprises:

cooling fluid passages having cooling fluid outlets at said leading edge of said panel; and cooling fluid passages having cooling fluid outlets at said trailing edge of said panel.

17. The ring segment of claim 16, wherein cooling fluid inlets of said cooling fluid passages are located in said cooling fluid supply trench and are located radially inwardly from said outer side of said panel.

18. The ring segment of claim 15, wherein said cooling fluid passages have a diameter of from about 0.25 mm to about 2 mm, and wherein a pitch between adjacent ones of said cooling fluid passages comprises from about 0.5 mm to about 16 mm.

19. The ring segment of claim 15, wherein a width dimension of said cooling fluid supply trench is at least about 2 times a diameter of said cooling fluid passages.

* * * * *